US006579329B1

(12) United States Patent
Thomas et al.

(10) Patent No.: US 6,579,329 B1
(45) **Date of Patent: *Jun. 17, 2003**

(54) MIXTURE SUITABLE AS A FUEL ADDITIVE AND LUBRICANT ADDITIVE AND COMPRISING AMINES, HYDROCARBON POLYMERS AND CARRIER OILS

(76) Inventors: Jürgen Thomas, Merowinger Str.5, 67136 Fussgönheim (DE); Harald Schwahn, Schloss-Str. 68, 69168 Wiesloch (DE); Peter Schreyer, Staffelprankelweg 3, 69469 Weinheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 26 days.

(21) Appl. No.: 08/650,549

(22) Filed: May 20, 1996

Related U.S. Application Data

(63) Continuation of application No. 08/531,604, filed on Sep. 21, 1995, now abandoned.

(30) Foreign Application Priority Data

Sep. 28, 1994 (DE) ..... 44 34 603

(51) Int. Cl.[7] ..... C10L 1/18; C10L 1/22

(52) U.S. Cl. ..... 44/388; 44/389; 44/398; 44/412; 44/433; 44/443; 44/459; 208/16

(58) Field of Search ..... 508/545, 556; 44/412, 433, 443, 459, 388, 389, 398; 208/16

(56) References Cited

U.S. PATENT DOCUMENTS

| | | | | |
|---|---|---|---|---|
| 3,658,495 A | * | 4/1972 | Dorer et al. | |
| 3,756,793 A | * | 9/1973 | Robinson | |
| 4,200,518 A | * | 4/1980 | Mulvany | |
| 4,409,000 A | * | 10/1983 | Le Suer | |
| 4,832,702 A | * | 5/1989 | Kummer et al. | 44/398 |
| 5,004,478 A | * | 4/1991 | Vogel | 44/398 |
| 5,006,130 A | | 4/1991 | Aiello et al. | 44/432 |

FOREIGN PATENT DOCUMENTS

| | | | |
|---|---|---|---|
| DE | 3611230 | * | 8/1987 |
| DE | 36 11 230 | | 10/1987 |
| EP | 0 244 616 | | 11/1987 |
| EP | 0 330 522 | | 8/1989 |
| EP | 0 356 726 | | 3/1990 |
| EP | 0 374 461 | | 6/1990 |
| EP | 0 460 957 | | 12/1991 |
| EP | 0 462 319 | | 12/1991 |
| EP | 0 505 070 | | 9/1992 |
| EP | 0 530 094 | | 3/1993 |
| EP | 0 588 429 | | 3/1994 |
| EP | 0 628 622 | | 12/1994 |
| WO | WO 91/03529 | | 3/1991 |
| WO | WO 91/13949 | | 9/1991 |
| WO | WO 92/02601 | | 2/1992 |
| WO | WO 92 21736 | | 12/1992 |

* cited by examiner

*Primary Examiner*—Margaret Medley

(57) ABSTRACT

A mixture suitable as fuel additive and lubricant additive and comprising essentially (A) at least one amine which carries a hydrocarbon radical having an average molecular weight of from 500 to 10,000, (B) at least one hydrocarbon polymer which has an average molecular weight of from 300 to 10,000 and may be present in unhydrogenated or hydrogenated form and (C) at least one conventional carrier oil has a weight ratio of component A to component B of from 80:20 to 60:40.

8 Claims, No Drawings

MIXTURE SUITABLE AS A FUEL ADDITIVE AND LUBRICANT ADDITIVE AND COMPRISING AMINES, HYDROCARBON POLYMERS AND CARRIER OILS

This application is a Continuation of application Ser. No. 08/531,604, filed on Sep. 21, 1995, now abandoned.

The present invention relates to a novel mixture suitable as a fuel additive and lubricant additive and comprising essentially (A) at least one amine which carries a hydrocarbon radical having an average molecular weight of from 500 to 10,000, (B) at least one hydrocarbon polymer which has an average molecular weight of from 300 to 10,000 and may be present in unhydrogenated or hydrogenated form and (C) at least one conventional carrier oil.

The present invention furthermore relates to the use of the mixture as fuel additives and lubricant additives and to fuels for gasoline engines and lubricant compositions which contain the mixture in effective amounts.

Carburettor and intake systems of gasoline engines, as well as injection systems for metering fuel into gasoline and diesel engines, are increasingly contaminated by impurities which are caused by dust particles from the air, uncombusted hydrocarbon radicals from the combustion space and the crankcase vent gases passed into the carburettor.

The residues adsorb fuel and shift the air/fuel ratio in the idling state and in the lower part-load range so that the mixture becomes richer and the combustion more incomplete and in turn the proportions of uncombusted or partly combusted hydrocarbons in the exhaust gas become larger and the gasoline consumption increases.

It is known that the intake system of gasoline engines can be kept clean by adding detergents (cf. for example M. Rosenbeck in Katalysatoren, Tenside, Mineralöladditive, Editors J. Falbe and U. Hasserodt, page 223 et seq., Thieme Verlag, Stuttgart 1978, and Ullmann's Encyclopedia of Industrial Chemistry, Vol. A 16, 719 et seq., 1990, VCH Verlagsgesellschaft). Emissions and fuel consumption are thus reduced and the driving characteristics improved. The molecular structural principle of such detergents can generally be described as the linking of polar structures to generally relatively high molecular weight lipophilic radicals. Typical examples of these are products based on polyisobutene having amino groups as polar groups, as described in EP-A 244 616 (1).

The publication (1) furthermore states that, in fuel additives, up to about 50% by weight of the active substance, ie. of the polyisobutylamine, can be replaced by polyisobutene without loss of efficiency; such a replacement is made chiefly for cost reasons. There is no indication of an improvement in the efficiency with certain amounts of polyisobutene.

A further important additive component for fuels are carrier oils. These carrier oils are, as a rule, high-boiling heat-stable liquids. EP-B 356 726 (2) discloses esters of aromatic polycarboxylic acids with long-chain alcohols as carrier oils. EP-A 374 461 (3) describes combinations of polyethers based on propylene oxide and/or butylene oxide, having a molecular weight of at least 500, with esters of mono- or polycarboxylic acids and alkanols of the polyols, these esters having a minimum viscosity of 2 $mm^2/s$ at 100° C., which combinations increase the efficiency of the detergent through synergistic action mechanisms. U.S. Pat. No. 5,006,130 (4) discloses mixtures of aliphatic alkylenepolyamines with at least one oil-soluble synthetic or mineral carrier oil.

WO-A 91/03529 (5) describes the combination of detergents which carry certain amino groups with polyetheralcohols as carrier oils. In particular, this combination contributes less than its individual components to the octane requirement increase (ORI), which is due to deposits of the fuel or of the additives on engine parts. It is only after a considerable running time that a new engine reaches its final octane requirement, which may then be considerably higher than at the beginning. In general, additives should at least not enhance this effect.

The known prior art additives still do not have the optimum cleaning effect in the engine, and in particular the prevention or reduction of valve deposits is still unsatisfactory.

It is an object of the present invention to provide fuel additives and lubricant additives having improved efficiency as detergents.

We have found that this object is achieved by the mixture defined at the outset, which has a weight ratio of component A to component B of from 80:20 to 60:40, in particular from 77:23 to 65:35.

Component A

Component A is effective in fuels primarily as a detergent. Suitable components A are amines which have a hydrocarbon radical having an average molecular weight of from 500 to 10,000, preferably from 600 to 2500, particularly preferably from 700 to 1500.

The hydrocarbon radical is as a rule branched. In general, it is a radical which is obtainable by polymerization of olefins. These olefins are preferably $C_2$–$C_6$-olefins, such as ethylene, propylene, 1-butene or 1-pentene, particularly preferably isobutene. Both homopolymers and copolymers are suitable, for example polymers of from 70 to 100% by weight of isobutene and from 0 to 30% by weight of 1-butene. Owing to their preparation process, these polyolefins generally consist of a mixture of compounds of different molecular weights.

After chlorination, these polyolefins can be reacted with amines in a manner known per se. However, hydroformylation of the polyolefin and amination of the resulting aldehyde and alcohol mixture under hydrogenating conditions, as described, for example, in (1), is preferred, since this method leads to chlorine-free products. The amine group of the detergent A is derived from amines known per se, such as ammonia, primary amines, eg. methylamine, ethylamine, butylamine, hexylamine or octylamine, secondary amines, such as dimethylamine, diethylamine, dibutylamine or dioctylamine, or heterocycles, such as piperazine, pyrrolidine or morpholine, which may carry further inert substituents. Ammonia is particularly preferred.

A very particularly preferred embodiment of the component A is a polyisobutylamine having an average molecular weight of from 700 to 1500, it being possible for up to 20% of the isobutene units to be replaced by 1-butene units.

Component B

Particularly suitable hydrocarbon polymers B are the olefin polymers described as intermediates for component A. Such olefin polymers as component B have an average molecular weight of, preferably, from 400 to 1750, in particular from 500 to 1500. The hydrocarbon polymer B may furthermore contain olefinic double bonds as a result of its preparation; however, such double bonds may also have been hydrogenated. The component B however, may be added separately or may be introduced into the novel mixture by a suitable reaction procedure in the preparation of the component A from an excess of the olefin polymers described.

A very particularly preferred embodiment of the component B is polyisobutene having an average molecular weight of from 500 to 1500, it being possible for up to 20% by weight of the isobutene units to replaced by 1-butene units.

Both the component A and the component B may be mixtures of different individual compounds.

Component C

Suitable carrier oils C are in principle all compounds usually used for this purpose. However, particularly preferred carrier oils C are those selected from the following four groups:

(a) Mineral oils, for example naphthenic or paraffinic mineral oils having a viscosity of from 2 to 25 $mm^2/s$ at 100° C.;

(b) Polyethers based on propylene oxide and/or butylene oxide, in particular those having a molecular weight of at least 500; particularly suitable here are polyalkylene oxides which were initiated from a medium-chain or long-chain alkanol or alkanediol, from an amine of comparable chain length or from alkylphenol, for example from 1,6-hexanediol, 1,8-octanediol, isotridecanol, isononylphenol, isodecylphenol or isotridecylamine. Up to 50, in particular from 8 to 30, mol of propylene oxide or butylene oxide or of a mixture thereof, which may be incorporated in block or random form, may usually be reacted per initator molecule;

(c) Polyetheramines based on propylene oxide and/or butylene oxide and ammonia or primary or secondary mono- or polyamines, in particular those having a molecular weight of at least 500; such polyetheramines (c) are preferably prepared from polyethers (b) by amination by known methods, the terminal hydroxyl group being replaced by an amino group with elimination of water;

(d) Esters of mono- or polycarboxylic acids with alkanols or polyols, in particular those having a minimum viscosity of 2 $mm^2/s$ at 100° C.; mono- or polycarboxylic acids which may be used are aliphatic or, preferably, aromatic ones, and suitable ester alcohols or ester polyols are in particular long-chain ones of, for example, 6 to 24 carbon atoms; typical esters (d) are adipates, phthalates, isophthalates, terephthalates and trimellitates of isooctanol, of isononanol, of isodecanol and of isotridecanol.

However, poly-α-olefins or polymers of internal olefins, ie. olefins having nonterminal double bonds, may also be used as carrier oils C.

In general, the mixtures of the stated carrier oils, for example of (a) and (b), (a) and (c), (a) and (d), (b) and (c) or (c) and (d), may also be used.

In a particularly preferred embodiment, a carrier oil mixture comprising polyethers (b) and esters (d) is used as component C, the weight ratio of (b) to (d) preferably being from 20:80 to 80:20, in particular from 35:65 to 65:35.

In the novel mixture, the weight ratio of the component C to the sum of amine A and hydrocarbon polymer B is usually from 5:95 to 85:15, in particular from 20:80 to 70:30.

The novel mixture may contain further components D, the amounts of D being from 0 to 40, preferably from 0 to 10, % by weight, based on the total weight of components A to C. These components D influence the properties of the novel mixtures only to a small extent with respect to their use in fuels.

The component D comprises additives known per se for mixtures which are added to fuels and lubricants. These are to be understood as meaning in particular corrosion inhibitors, demulsifiers, detergents or dispersants, such as amides and imides of polyisobutylsuccinic anhydride.

The present invention also relates to the use of the mixture described, comprising the components A to C, as fuel and lubricant additives.

The present invention furthermore relates to fuels for gasoline engines which contain effective amounts of the novel mixture.

Suitable fuels are leaded and unleaded regular and premium-grade gasoline. The gasolines may also contain components other than hydrocarbons, for example alcohols, such as methanol, ethanol or tert-butanol, and ethers, such as methyl tert-butyl ether.

The novel fuels contain the mixtures of the components A to C in general in amounts of in each case from 10 to 5000 ppm, preferably from 50 to 1000 ppm, based on the total weight. In addition to the components D described above, the novel fuels may furthermore contain antioxidants, eg. N,N'-di-sec-butyl-para-phenylene-diamine, and stabilizers, eg. N,N'-disalicylidene-1,2-diaminopropane.

The components A to C can be mixed to give clear, homogeneous solutions. Fuels to which these have been added exhibit substantially less valve deposits compared with the pure fuels. Furthermore, the additives do not contribute to an octane requirement increase (ORI).

The present invention furthermore relates to lubricant compositions which contain effective amounts of the novel mixture. Effective amounts are to be understood here as meaning, as a rule, from 0.1 to 6, in particular from 0.5 to 5, % by weight, based on the weight of the lubricant composition.

EXAMPLES

Determination of valve deposits by engine tests in the Mercedes-Benz M 102 E according to CEC-F-05-T-92

In the engine test, mixtures of the components A, B and C and, for comparison, mixtures of the components A and C were tested with regard to their efficiency in keeping the intake valves clean. The fuel used was unleaded European premium grade.

| Example No. | Component | Amount [ppm = mg/kg of fuel] | Average valve deposits [mg] |
|---|---|---|---|
| | For comparison: | | |
| 1 | A: PIBA (M about 1000) [a] | 300 | 83 |
| | C: Mineral oil [d] | 300 | |
| 2 | A: PIBA (M about 1000) [a] | 300 | 70 |
| | C: Polyether [e] | 300 | |
| 3 | A: PIBA (M about 1000) [a] | 300 | 80 |
| | C: Ester [f] | 300 | |
| | According to the invention: | | |
| 4 | A: PIBA (M about 1000) [a] | 300 | 48 |
| | B: PIB (M about 1000) [b] | 150 | |
| | C: Polyether [e] | 150 | |
| 5 | A: PIBA (M about 1000) [a] | 300 | 60 |
| | B: PIB (M about 1000) [b] | 150 | |
| | C: Ester [f] | 150 | |

-continued

| Example No. | Component | Amount [ppm ≙ mg/kg of fuel] | Average valve deposits [mg] |
|---|---|---|---|
| 6 | A: PIBA (M about 1000) [a]) | 300 | 15 |
| | B: PIB (M about 1000) [b]) | 100 | |
| | C: Polyether [e]) | 100 | |
| | Ester [f]) | 100 | |
| 7 | A: PIBA (M about 1000) [a]) | 300 | 7 |
| | B: PIB (M about 700) [c]) | 100 | |
| | C: Polyether [e]) | 100 | |
| | Ester [f]) | 100 | |

[a]) commercial polyisobutylamine (average molecular weight about 1000)
[b]) unhydrogenated polyisobutene (average molecular weight about 1000)
[c]) unhydrogenated polyisobutene (average molecular weight about 700)
[d]) commercial mineral oil based on a mineral oil distillation cut having a viscosity of 11 $mm^2/s$ at 100° C.
[e]) isotridecanol reacted with 22 mol of butylene oxide
[f]) diisodecyl phthalate The substantially higher efficiency of the novel mixture according to Examples 4 to 7 compared with the mixtures without component B according to Examples 1 to 3 is evident.

We claim:

1. A detergent mixture consisting essentially (A) at least one amine which carries a hydrocarbon radical having an average molecular weight of from 500 to 10,000, said hydrocarbon radical being obtained by polymerization of $C_2$–$C_6$ olefins, (B) at least one hydrocarbon polymer which has an average molecular weight of from 300 to 10,000 and may be present in unhydrogenated or hydrogenated form said hydrocarbon polymer being obtained by polymerization of $C_2$–$C_6$ olefins, and (C) at least one conventional carrier oil, which mixture has a weight ratio of component A to component B of from 80:20 to 60:40.

2. A detergent mixture as claimed in claim 1, which has a weight ratio of component A to component B of from 77:23 to 65:35.

3. A detergent mixture as claimed in claim 1, in which component A is a polyisobutylamine having an average molecular weight of from 700 to 1500 and having up to 20% by weight of the isobutene units replaced by 1-butene units.

4. A detergent mixture as claimed in claim 1, in which component B is a polyisobutene having an average molecular weight from 500 to 1500 and having up to 20% by weight of the isobutene units replaced by 1-butene units.

5. A detergent mixture as claimed in claim 1, in which said Component C is selected from the group consisting of (a) mineral oils, (b) polyethers based on propylene oxide or butylene oxide, (c) polyetheramines based on propylene oxide or butylene oxide and ammonia or primary or secondary mono- or poly-amines and (d) esters of mono- or polycarboxylic acids and alkanols or polyols.

6. A detergent mixture as claimed in claim 5, in which said Component C is a mixture comprising (b) polyethers based on propylene oxide or butylene oxide and (d) esters of mono- or polycarboxylic acids and alkanols or polyols.

7. A gasoline fuel composition comprising gasoline and a detergency effective amount of a detergent mixture as claimed in claim 1.

8. A gasoline fuel composition comprising gasoline and from 10 to 5000 ppm of a detergent mixture as claimed in claim 1.

* * * * *

UNITED STATES PATENT AND TRADEMARK OFFICE

CERTIFICATE OF CORRECTION

PATENT NO. : 6,579,329 B1
DATED : June 17, 2003
INVENTOR(S) : Thomas et al.

It is certified that error appears in the above-identified patent and that said Letters Patent is hereby corrected as shown below:

Title page,
Item [75], Inventors, should read:

-- [75] Inventors: Jürgen Thomas, Fussgönheim (DE);
Harald Schwahn, Wiesloch (DE);
Peter Schreyer, Weinheim (DE) --

Signed and Sealed this

Fourteenth Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,579,329 B1
DATED : June 17, 2003
INVENTOR(S) : Juergen Thomas et al.

It is certified that error appears in the above-identified patent and that said Letters Patent is hereby corrected as shown below:

Title page,
Item [73], Assignee, should read:
-- [73] Assignee: BASF Aktiengesellschaft, Ludwigshafen (DE) --

Signed and Sealed this

Twenty-seventh Day of January, 2004

JON W. DUDAS
*Acting Director of the United States Patent and Trademark Office*